United States Patent [19]

Schmidt

[11] 4,032,112

[45] June 28, 1977

[54] CLIMBING JACK

[75] Inventor: Hans Heinrich Schmidt, Doncaster, Australia

[73] Assignee: Enor Nominees Pty Limited, Victoria, Australia

[22] Filed: Mar. 16, 1976

[21] Appl. No.: 667,451

Related U.S. Application Data

[62] Division of Ser. No. 554,235, Feb. 28, 1975, Pat. No. 4,016,228, which is a division of Ser. No. 448,716, March 6, 1974, abandoned.

[30] Foreign Application Priority Data

Mar. 7, 1973 Australia ..... 2511/73
Mar. 7, 1973 Australia ..... 2513/73

[52] U.S. Cl. ..... 254/108
[51] Int. Cl.[2] ..... B66F 1/08
[58] Field of Search ..... 254/105, 108–111

[56] References Cited

UNITED STATES PATENTS

| | | | |
|---|---|---|---|
| 2,775,869 | 1/1957 | Pointer | 254/106 |
| 3,214,036 | 10/1965 | Lich | 254/110 |
| 3,273,859 | 9/1966 | Walli | 254/109 |

FOREIGN PATENTS OR APPLICATIONS

| | | | |
|---|---|---|---|
| 2,158,421 | 11/1971 | Germany | 254/108 |
| 242,233 | 8/1959 | Netherlands | 254/108 |

*Primary Examiner*—Al Lawrence Smith
*Assistant Examiner*—Robert C. Watson
*Attorney, Agent, or Firm*—Murray and Whisenhunt

[57] ABSTRACT

A climbing jack is disclosed, wherein the jack comprises a jack column, and two climbing jack sections, connected by a hydraulic cylinder or a pair of hydraulic cylinders. The jack sections climb along the jack column in a crab-style fashion. Each jack section has at least one pawl which has an axle which extends substantially transversely of the longitudinal axis of the jack column. The pawl has two ends which are adapted by being pivoted about the pawl axle to move either end into biased contact with the jack column, and to thereby engage receiving apertures or projections along the jack column. The pawl ends are biased by opposed biasing springs which selectively bias either one of the ends of the pawl towards the jack column.

The climbing jack of the present invention is particularly suited for use in apparatus for progressively constructing a wall of cementitious material, wherein the jack column is periodically raised with respect to the jack sections, and wherein during alternate periods of time, the jack sections are raised along the jack column, thereby raising formwork sections attached to the jack sections.

18 Claims, 6 Drawing Figures

CLIMBING JACK

Figure 1:
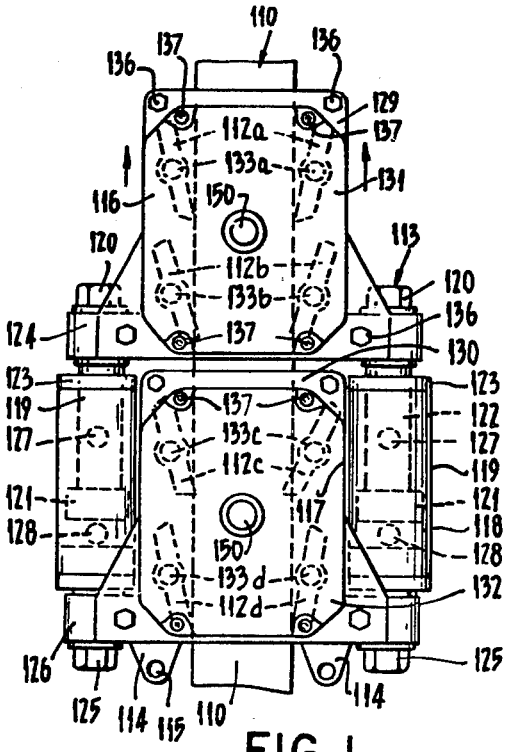

This is a division of application Ser. No. 554,235 filed Feb. 28, 1975 now U.S. Pat. No. 4,016,228 which is a division of Ser. No. 448,716, filed Mar. 6, 1974 now abandoned.

This invention relates to an improved climbing jack which is particularly suited for use in progressively constructing a wall of cementitious material.

The climbing jack of this invention facilitates the handling of formworks used particularly for constructing vertical concrete walls for buildings and other structures.

It has been found in normal practice that considerable time is spent in assembling, and then dismantling and reassembling, the same individual formwork components in the same relative position only at a higher level during building construction or wall construction. In addition to the manpower used in this repetitive work, a crane or some other mechanical device must be used to support and elevate the individual formwork components.

In another well known process for adding steel reinforcing and fresh concrete to vertically sliding preassembled wall forms there is provided a method whereby the formwork is not dismantled and reassembled continuously, and instead the entire formwork is raised by its own hydraulic jacking system. One major problem with this known building process is that the forms used to contain the fresh concrete are subjected to pressure from the fluidized concrete. This pressure or force must be resisted by a rigid inverted U, or A, frames or yokes. These relatively rigid yokes must be closely spaced along the walls and near all corners of the walls in order to resist the tendency for the concrete pressures at various points to change the thickness of the wall or the shape of the structure. The cost of these numerous yokes is considerable and they congest the working area above the wall, particularly at the corners of the wall.

A further disadvantage lies in the fact that the concrete is produced by a moving form thus producing problems such as the wall surface directly opposite the formwork requires finishing, concrete slurry builds up on the face of the moving form and increases the problem of producing rough surfaces, the wall corners are often torn, door and window openings have rough edges due to loss of slurry in the concrete, textured surface finishes are not possible, placement of blackouts in the moving form are difficult whilst the holding down of the blockouts in the moving form is difficult.

Furthermore partial redesign of building is necessary to suit such a so-called slipform process. It is also difficult to stop said form in an emergency, and the fact that the forms often bond to the wall at the completion of the pour the forms must be cleaned on exposed faces after completion of the pour.

A further disadvantage is in the fact that the quantities and nature of the materials in the concrete must be capable of solidifying within the moving form, thus the concrete setting rate which is also subject to changes in the weather temperature must be carefully controlled. Failure to predict the concrete setting rate can result in a loss of partially solidified concrete from the wall below the sliding form, or the hardened concrete adhering to the moving form.

Furthermore it is difficult to obtain access for personnel and materials to the moving form and also it is difficult and expensive to alter wall thickness, and finally a considerable amount of technical expertice is necessary to control the direction of the form.

A still further problem with this method of concrete wall construction is the numerous jack rods which support the formwork via hydraulic jacks mounted in the closely spaced yokes. These rods are generally expended as they are cast in the wall or individually removed after, or during, construction of the wall. These small diameter steel rods are also subject to considerable vertical load and thus they have a limited capacity to resist buckling. The steel rods therefore must be supported laterally either by setting concrete or temporary timber supports, both of which are subject to failure.

In another known building construction method a separate overhead support system is used in association with the formwork. This method consists of an overhead support frame used to raise the formwork in part, or whole, with the overhead support frame itself when being raised. The overhead support frame is supported on columns fixed to the wall below the formwork. However, this system involves a considerable quantity of falsework whilst two lifting systems are also required.

It is an object of the present invention to provide an improved climbing jack for constructing concrete walls or the like, which climbing jack is not subject to any of the above disadvantages associated with known climbing jack design for use in supporting formworks for concrete structures.

It is also an object of this invention to provide a climbing jack which comprises a jack column and interconnected jack sections, wherein the jack sections are supported from the jack column, or are engaged therewith, by means of double-ended pawls, which double-ended pawls are biased by opposed springs in order to selectively bias one end of the pawls toward the jack column.

The present invention therefore involves a climbing jack which is particularly suitable for use in progressively constructing a wall of cementitious material, including the steps of supporting a formwork support structure on a lower foundation, or completed wall section, by means of at least one jack means, raising said formwork support structure by said jack means to a higher pouring position, supporting said formwork support structure on the lower foundation, or wall section, by auxiliary support means, raising said jack means, moving a formwork section on at least one side of said wall toward a formwork section on the opposite side of said wall to provide a cavity for the receipt of cementitious material, pouring a quantity of said material into said space between said formwork sections, the lower foundation, or completed wall section, and the jack means, allowing said cementitious material to solidify, and separating said formwork sections, with said formwork support structure being supported on said jack means.

The present invention also involves a climbing jack highly suitable for use with an apparatus for progressively constructing a wall of cementitious material including a formwork support structure, at least one pair of inner and outer formwork sections suspended from said support structure, at least one of which is adapted to move toward and away from the other, at least one jack means adapted to support said formwork support structure on a lower foundation or completed wall section and operable to lift said formwork support structure, said jack means being adapted to be movable to an upper lift position, retractable support means carried by said support structure and adapted to support said formwork support structure on the lower foundation or completed wall section when said jack means are moved to said upper lift position.

Preferably said jack means is at least one hydraulic jack of the type where the load to be lifted, in this case the formwork support structure, is carried by a hydeaulic ram assembly adapted to climb up a vertically extending jack tube the lower end of which engages in the top edge of the lower foundation or completed wall section.

The present invention is directed to a climbing jack which is particularly suitable for use with the apparatus disclosed in my U.S. Pat. No. 3,973,885, the disclosure of which is hereby incorporated by reference for disclosure of the apparatus, and method of constructing cementitious walls, disclosed therein.

Figure 2:
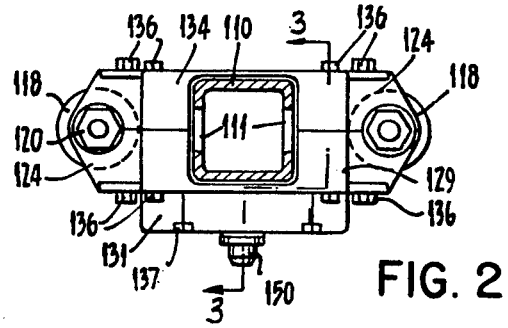
Figure 3:
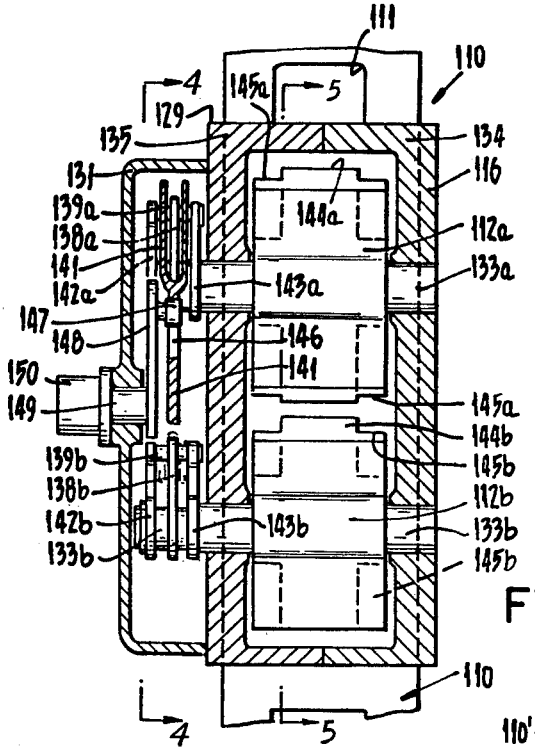
Figure 6:
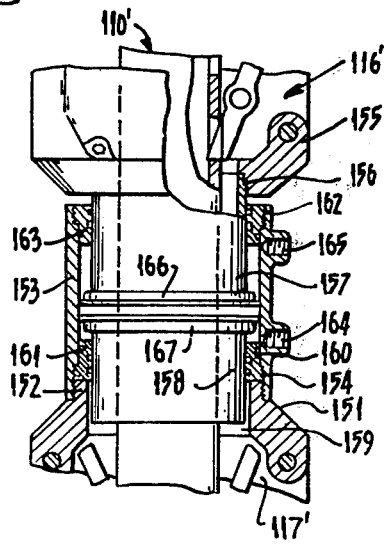
Figures 4, 5:
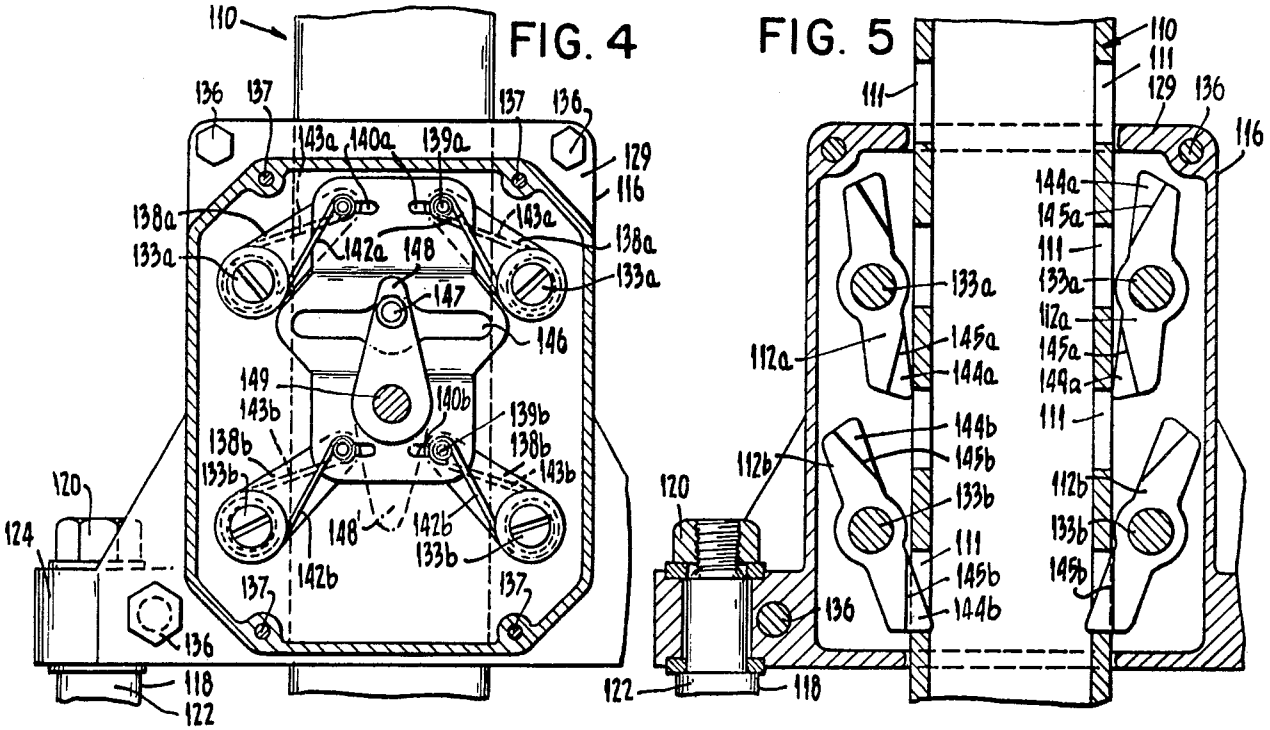

The invention will now be described with reference to the accompanying drawings in which, FIG. 1 is a front elevational view of a climbing jack of the present invention, FIG. 2 is a plan view of the jack of FIG. 1, FIG. 3 is a side elevational view taken along line 12—12 of FIG. 2, but showing only the upper section of the jack as shown in FIG. 1, FIG. 4 is a front elevational view taken along line 13—13 of FIG. 3, FIG. 5 is a front elevational view taken along line 14—14 of FIG. 3, and FIG. 6 is a side elevational view of a second preferred form of a climbing jack of the present invention.

Referring to FIGS. 1 to 5 which illustrate a first preferred form of jack, the jack tube 36 is a hollow elongate member with a plurality of closely and evenly spaced apertures 111 along its length adapted to receive reversible pawl sets 112*a*, 112*b*, 112*c* and 112*d* or like devices, mounted on a jack assembly 37 which in turn supports the formwork support structure to be lifted for which ears 114 with holes 115 therein may be provided for the receipt of the attachment bolts 58.

The jack assembly 37 consists of upper and lower pawl supporting sections 116 and 117 respectively separated, and connected together, by a pair of hydraulic ram arrangements 118 placed on opposite sides of the jack column 36. Each hydraulic ram arrangement 118 comprises a cylinder body 119, attached by means of a bolt 125 to a lower flange 126 on the lower pawl supporting section 117, and a piston 121 adapted to move inside said cylinder body 119 and connected to a piston rod 122 extending through a closure member 123 to a bolted connection 120 at a lower flange 124 for the upper pawl supporting section 116. A port 127 for pressurized hydraulic fluid, and in communication a source of pressurized hydraulic fluid through a selection valve (not shown), is provided in the upper end of each cylinder body 119 to deliver pressurized fluid to, and from, the piston rod side of each piston 121 whilst a further port 128, also in communicaton with the selection valve, is provided in the lower end of each cylinder body 119 to deliver pressurized fluid to, and from, the opposite side of the piston. The piston includes a circumferentially extending sealing member whilst appropriate sealing members are also positioned around the piston rod 122 and in the closure member 123 to seal the hydraulic ram arrangement. Relative movement between the upper and lower pawl supporting sections 116 and 117 is achieved by selectively delivering pressurised fluid to one side of the piston and exhausting from the other by virtue of a suitable selection valve, and many forms of valves suitable for this purpose are available and would be adapted in a manner well known to those skilled in the art.

Each pawl supporting section 116 and 117 comprises a main housing 129 and 130 respectively in which the pawl sets 112*a*, 112*b*, 112*c* and 112*d* are supported, and an auxiliary housing 131 and 132 respectively containing mechanisms for selectively biasing the pawls into positions allowing relative movement between the jack assembly 37 and the jack tube 36 in opposite directions. The housing 129 for the upper pawl supporting section 116 supports pawl sets 112*a* and 112*b* one above the other on support axles 133*a* and 133*b* respectively which are positioned midway between the ends of the respective pawls, whilst the housing 130 for the lower pawl supporting section 117 supports pawl sets 112*c* and 112*d* one above the other on support axles 133*c* and 133*d* respectively and positioned midway between the ends of the respective pawls.

As the details of each pawl supporting section 116 and 117 are identical the following description with particular reference to FIGS. 3, 4 and 5, will be only concerned with the construction of the upper section 116.

The main housing 129 comprises two halves 134 and 135 in the faces of which holes are provided to form bearing supports for the support axles 133*a* and 133*b* and the two halves when assembled are attached by bolt fasteners 136. The auxiliary housing 131 is attached to one face of the main housing 129 by recessed bolt fasteners 137 and contains the mechanism for selectively biasing the pawls.

The pawls 133*a* and 133*b* in each pawl set are selectively biased into positions where either their lower ends or their upper ends bear against the jack rod 36 and at various times during operation engage in the apertures 111 in the jack rod 36.

The mechanism for selectively biasing the pawls such that either their lower or their upper ends engage the jack rod (with particular reference to FIGS. 3 and 4) comprises a pawl link 138*a* and 138*b* for the pawls 133*a* and 133*b* respectively of each set pivotably mounted upon the respective axles 133*a* and 133*b*. The ends of the link 138*a* and 138*b* remote from their connection to the axles carry pins 139*a* and 139*b* respectively which slidingly engage in slots 140*a* and 140*b* respectively provided in a vertically movable shift plate 141. With particular reference to FIG. 3 the shift plate 141 is forked at either end and the legs of each fork lie on opposite sides of the respective link 138*a* and 138*b*. A pair of torsion springs 142*a* and 143*a*, and 142*b* and 143*b* respectively, are provided for each pawl. One torsion spring 142*a* and 142*b* of each pair has one end coiled around the respective support axle 133*a* and 133*b* in one direction, with the extremity of that end of the torsion spring held captive to the respective support axle 133*a* and 133*b* by receipt in a hole extending transversely through the support axle, and the spring extends to the associated pin 139*a* and 139*b* respectively for captive hook engagement thereabout in the opposite direction as shown. The other torsion spring 143*a* and 143*b* of each pair engages the axle 133*a* and 133*b* and the associated pins 139*a* and 139*b* in the opposite direction as shown particularly in FIG. 4.

With the shift plate 141 in an upper position the pins 139*a* and 139*b* and the ends of the torsion springs will be in an upward position, and the torsion springs 142*a* and 142*b* will, in this position, maintain a net torque on the support axles 133*a* and 133*b* in such a direction as to maintain the pawls 112*a* and 112*b* with their lower ends biased toward the jack rod 36, in the orientation shown in FIG. 5, such that when aligned with an aperture 111 the lower ends will move into and engage the relevant aperture.

In order to alter the orientation of the pawls such that their upper ends are biased against the jack rod 36, the shift plate 141 is shifted downwardly to simultaneously draw the pins 139*a* and 139*b* to a downward position, and to draw the links 138*a* and 138*b* to a downwardly inclined position with lateral movement of the pins 139*a* and 139*b* being accommodated in the slotted holes 140*a* and 140*b* respectively. The downward movement of the pins 139*a* and 139*b* relieves the torsional effect of the torsion springs 142*a* and 142*b* on the respective axles 133*a* and 133*b*, whilst torsion springs 143*a* and 143*b* come into action to rotationally bias the axles 133*a* and 133*b* and the pawls 112*a* and 112*b* attached thereto in the opposite direction to maintain the upper ends of the pawls bearing under pressure on the jack rod 36, to engage in an aperture 111 during various stages of operation of the jack.

Referring particularly to FIGS. 3 and 5, each pawl 112*a* and 112*b* has cut away sections on either side thereof at either end forming a raised portion 144*a* and 144*b* and ledges 145*a* and 145*b*. The raised portion 144*a* and 144*b* are of a width slightly less than the width of the aperture 111 thereby allowing these portions to enter and engage the apertures, whilst the ledges 145*a* and 145*b* engage and rest against the surfaces adjacent the sides of the aperture to limit the amount of the pawl which enters the aperture to equivalent to the height of the portions 144*a* and 144*b*.

In order to vertically shift the shift plate 141, the effect of which is to alter the direction of the net spring biasing torque applied to, and the resulting orientation of, the pawls 112*a* and 112*b*, the central section of the shift plate 141 is provided with a through slot 146 (see FIG. 4) in which a pin 147 on one end of a shift lever 148 is received. The opposite end of the shift lever 148 is fixedly attached to a shift shaft 149 passing through the face of the auxiliary housing 131 and having an outer end 150 adapted for engagement by a key tool (not shown) to allow rotation of the shift shaft 149 in either direction. Rotation of the shaft 149 causes rotation of the shift lever 148 attached thereto to the position shown in phantom as 148′ and in so doing the pin 147 cooperating with the slot 146 pulls the shift plate 141 and captive pins 139*a* and 139*b* downwardly. The torsion spring ends hooked around the pins 139*a* and 139*b* will be in a downward position, resulting in a reversal of the rotation bias exerted by the respective pairs of torsional springs upon the respective axles and pawls associated therewith, whereby the upper ends of the pawls 112*a* and 112*b* then bear against the jack rod 36. Rotation of the shift shaft 149 a further 180° in either direction shifts the lever 148 back to the upper position shown in FIG. 4, thereby again reversing the direction of the biasing torques imposed by the torsion spring arrangements to return all pawls to the position shown in FIG. 14.

The pawls 112*a* and 112*b*, or 112*c* and 112*d*, in each of the upper and lower sections 116 and 117 are spaced apart a distance greater than the distance between adjacent apertures 111, such that, at any one time only one set of pawls in each section 116 and 117, when the sections are at a fixed position relative to the jack rod, are engaged in the apertures (see FIGS. 1 and 5). The stroke of the hydraulic ram arrangements 118 are such that the relative movement between each section 116 and 117 and the jack rod 36 will be over a distance such that one of the sets of pawls in each section previously not engaged in apertures will move to an engaging position, whilst the other set of pawls formerly engaged will move out of engagement.

Referring particularly to FIG. 1, to enable the jack assembly 37 to move up the jack rod 36 carrying the formwork support structure supported therefrom, all pawls 112*a*, 112*b*, 112*c* and 112*d* are biased towards the position shown in FIG. 1, that is, with their lower ends bearing against the jack rod 36 whereby they engage, or tend to engage, in the apertures 111. In the position shown in FIG. 1 the lower set of pawls 112*b* in the upper section 116, and the upper set of pawls 112*c* in the lower section 117, are engaged in apertures 111, whilst pawls 112*a* and 112*d* are not. Upon applying fluid pressure through the lower port 128 and exhausting through the upper ports 127, the hydraulic ram arrangements 118 lift the upper jack section 116, and during upward movement for the full stroke of the rams 118, the lower pawls 112*b* disengage from the apertures 111 and upon reaching the full extent of the stroke the upper pawls 112*a* then engage in apertures 111 effectively space two above the ones from which the pawls 112*b* have disengaged. Meanwhile lower section 117 has remained fixed relative to the jack rod and supported on the pawls 112*c* which have remained in engagement with apertures 111. Upon reversal of the point of delivery of the fluid pressure to the ram arrangements the upper section 116 remains fixed relative to the jack rod 36 and supported on pawls 112*a*, but the lower section 117 then lifts to once again meet the upper section 116 with the upper pawls 112*c* disengaging from the apertures 111 against the action of their active torsion springs and the lower pawls 112*d*, upon reaching an aperture, engage therein. Upon further reversal of pressurised fluid to the ram arrangements the upper section 116 again lifts, pawls 112*a* disengage from the aperture 111, pawls 112*b* move into and engage the next set of apertures in their path whilst the lower section 117 remains supported on pawls 112*d*. Still further reversal of fluid pressure to the ram arrangement 118 lifts the lower section 117 up to meet the upper section again, pawls 112*d* disengage from their apertures, pawls 112*c* move into the next set of apertures in their path and the orientation of all the pawls having regard to their engagement in the apertures has returned to the situation as illustrated in FIG. 1 except that the whole jack has effectively risen a distance equivalent to the distance between an adjacent pair of apertures. As the cycle of movement is repeated the jack and thus the load suspended thereon climbs up the jack rod 36.

When it is desired to lift the jack rod 36 up through the jack assembly 37, that is, by holding the jack assembly 37 at a fixed height via the auxiliary support means and lifting the jack rod 36 through the assembly 37, such as required to carry out the inventive continuous wall building technique, the orientation of all pawls is reversed in the manner previously described, such that the upper ends of all pawls engage, or tend to engage, the apertures 111. The pawls instead of resting on the lower edges of the aperatures, as was the case with the jack assembly when moving up the jack rod, bear against the upper edges of the apertures 111 which has the effect during movement of the ram arrangement to push the jack rod up through the assembly 37 whilst the assembly 37 is held at a fixed position.

Referring to FIG. 6 of the drawings, an alternative form of jack is described. The upper and lower jack sections 116' and 117' and the jack rod 36' are basically the same as the sections 116 and 117 and rod 36 in the embodiment of FIGS. 1–5, and in so far as the arrangement and operation of the pawls, and the mechanism for reversing their orientation to reverse the relative movement between the jack assembly and the jack rod are concerned, these are identical. In this alternative embodiment the modification merely relates to an alternative form of hydraulic ram arrangement for obtaining relative movement between the upper and lower jack sections 116' and 117'.

In this embodiment the hydraulic ram arrangements 118 and the provision for their attachment to the upper and lower jack sections 116 and 117 in the embodiment of FIGS. 1–5 are dispensed with. The lower jack section 117' is formed at its upper end, or has attached thereto, a tapering connection portion 151 merging into an upwardly extending cylindrical externally threaded flange 152. An outer cylindrical sleeve 153 internally threaded at one end 154 for cooperation with the threaded flange 152 is provided. The lower end of the jack section 116' also has a tapering connection portion 155 formed thereon, or attached thereto, and is internally threaded at 156 to receive a hollow piston support member 157 which surrounds the jack rod 36' and is adapted to extend downwardly inside, coaxially with respect to, but spaced from, said sleeve 153 with its lower end 158 received in a circular opening 159 inside the flange 152 and connection portion 151 on the lower jack section 117'.

A lower sealing member 160 is positioned between the piston support member 157 and the sleeve 153 adjacent the threaded flange 152 and carries an externally threaded portion 161 for engagement with the internal thread at the lower end 154 of the sleeve 153, and carries a number of inner and outer sealing rings. The upper end of the sleeve 153 is internally threaded at 162 and receives a cooperatingly externally threaded upper sealing member 163 positioned between the sleeve 153 and the piston support member 157 with a number of inner and outer sealing rings provided thereon.

The arrangement and disposition of the sleeve 153, the piston support member 157 and the sealing members 160 and 163, effectively provide an annular sealed cavity into which pressurised fluid can be alternatively introduced and exhausted through ports 164 and 165 in the sleeve and adjacent either end thereof. The piston support member 157 carries an annular piston member 166 fixed thereto and having sealing rings 167 provided in the circumferential surface thereof and movable back and forth with the support member 157 as pressurized fluid is directed through port 164 to one side of the piston member 166 whilst fluid on the other side exhausts through port 165, and vice versa. This arrangement is merely an alternative to using the separate hydraulic ram assembly 118 of the embodiment of FIGS. 1–5.

It should be understood that the hydraulic ram arrangements 118 could be replaced by pneumatic ram arrangements or alternatively any other form of force applying means positioned between the upper and lower jack sections 116 and 117. Alternatively the pawls should have their ends adapted to engage projections provided on the external surface of hollow or solid jack rods or tubes. Alternatively in the case where apertures are provided, the apertures may be provided in a solid body and consist merely of cavities evenly spaced along and in the surface of the solid columns.

Furthermore, although each of the jack sections 116 and 117, or 116' and 117', carries two sets of pawls, in a simpler embodiment only one set of pawls may be provided in each section and the stroke of the ram arrangements, the spacing between the apertures 111 and the distance between the pawls in the lower and upper sections are arranged such that whilst one section is moving relative to the jack rod, or the jack rod is moving through one of the sections, the pawls in the other section are engaging the apertures and supporting the assembly.

The various components of the whole assembly may be constructed of any suitable material such as steel.

The various components of the apparatus may be manufactured from suitable components such as structural steel sections whilst the jacks may also be constructed from steel components.

I claim:

1. A climbing jack comprising jack column means, a plurality of receiving means substantially evenly spaced along said column means, a jack assembly means surrounding said column means and including a first jack section means and a second jack section means, each said jack section means including at least one lever means having an axle which extends substantially transversely of the longitudinal axis of said column means, said lever means having opposite ends selectively adapted by being pivoted about the axle to move either one of the ends into contact with said jack column means and to move the other end out of contact with said jack column means, opposed biasing spring means associated with said lever means for selectively biasing either one of said ends toward said jack column means and the other end away from said jack column means, and wherein an end of at least one lever means in one of the jack section means is in supporting engagement with said receiving means during relative movement of said jack column means and said jack assembly means, and at least one force applying means connecting said first jack section means and said second jack section means for moving one of said jack section means, in turn, relative to the other jack section means, along said column means while the said other jack section means is held in fixed relationship relative to said jack column means by engagement of at least one lever means in said other jack section means with at least one receiving means.

2. Jack of claim 1, wherein said opposed biasing spring means comprises a pair of opposed torsional spring means.

3. Jack of claim 2, wherein each pair of spring means for each respective lever means applies opposed torsional biasing forces to said lever means, and a net biasing torque in one direction produces bias of said lever means in said one direction and a net biasing torque in the opposite direction produces bias of said lever means in said opposite direction.

4. Jack of claim 3, wherein each said jack section means includes common shifting means cooperating with each axle to selectively simultaneously rotate the ends of said spring means remote from said axle means upwards or downwards about said axle means, thereby changing the rotational direction of the net torque exerted by said pair of spring means upon said axle means and said lever means to bias and rotate each axle and corresponding lever means in said one direction or in said opposite direction.

5. Jack of claim 2, wherein said jack is reversible in direction of relative movement of said jack column means and said jack assembly means.

6. Jack of claim 1 wherein each said jack section means includes at least one pair of said lever means at substantially the same lever and at substantially opposite sides of said jack column for simultaneously engaging with or disengaging from a plurality of substantially evenly spaced receiving means along said jack column on either side thereof and associated with the lever means on that respective side of said jack column means.

7. Jack of claim 1 wherein each jack section means includes two sets of said pairs of lever means spaced apart one set above the other at a distance such that at any one fixed position of a jack section means relative to the jack column means only one pair of lever means will be in engagement with adjacent receiving means, and upon movement of said jack section means along said column means over a predetermined distance, said one set of said lever means will disengage from their respective receiving means and the other set of lever means will engage the receiving means adjacent thereto.

8. Jack of claim 1, wherein said jack section means includes common shifting mechanism means cooperating with each axle to selectively simultaneously rotate each axle in said one direction or in said opposite direction.

9. Jack of claim 7 wherein said force applying means includes at least one hydraulic ram arrangement disposed between said first jack section means and said second jack section means.

10. Jack of claim 9, wherein said force applying means includes two hydraulic ram arrangements, one located on either side of said jack column means.

11. Jack of claim 10, wherein said force applying means is one hydraulic ram arrangement which surrounds said jack column means.

12. Jack of claim 7, further including attachment means for attaching a load to one of said jack section means.

13. Jack of claim 1 wherein said jack section means include a plurality of lever means spaced apart one above the other a distance such that at any one fixed position of the respective jack section means relative to the jack column means only a part of said lever means will be in engagement with adjacent receiving means, and whereby upon movement of said jack section means along said column over a predetermined distance said part of said lever means will disengage from said respective receiving means, and another part of said lever means will engage adjacent receiving means.

14. Jack of claim 13 wherein said plurality of lever means is two pairs of lever means, one pair of which is engaged and one pair of which is disengaged with receiving means at said respective positions.

15. A climbing jack comprising jack column means, a plurality of apertures substantially evenly spaced along said column means, a jack assembly means surrounding said column means and including a first jack section means and a second jack section means, each said jack section means including at least one pawl having an axle which extends substantially transversely of the longitudinal axis of said column means, said pawl having opposite ends selectively adapted by being pivoted about the axle to move either one of the ends into contact with said jack column means, and to move the other end out of contact with said jack column means, opposed biasing torsional spring means having one end thereof affixed to said axle for selectively biasing either end of said pawl toward said jack column means, wherein an end of said pawl in one of the jack section means is in supporting engagement with said apertures during relative movement of said jack column means and said jack assembly means, and at least one hydraulic ram connecting said first jack section means and said second jack section means for moving one of said jack section means in turn, relative to the other jack section means, along said column means, while the other said jack section means is held in fixed relationship relative to said jack column means by engagement of at least one pawl in said other jack section means with at least one aperture.

16. Jack of claim 15 wherein each of said pawls has an independent pair of torsional biasing spring means associated therewith.

17. Jack of claim 16, wherein for a given direction of relative movement of the jack column means with respect to the jack assembly means, all of said pawls are oriented in the same first biased position, and during movement in the opposite relative direction of travel, all pawls are oriented to a different, second biased position.

18. Jack of claim 17, wherein the opposite ends of said pawls are upper and lower ends, and in said first biased position all of said upper ends are biased toward said jack column means, and in said second biased position, all of said lower ends are biased toward said jack column means.

* * * * *